US012385490B2

(12) United States Patent
Yorikane et al.

(10) Patent No.: US 12,385,490 B2
(45) Date of Patent: Aug. 12, 2025

(54) GAS COMPRESSOR

(71) Applicant: HITACHI INDUSTRIAL EQUIPMENT SYSTEMS CO., LTD., Tokyo (JP)

(72) Inventors: Shigeyuki Yorikane, Tokyo (JP); Kenji Morita, Tokyo (JP); Yuta Kajie, Tokyo (JP)

(73) Assignee: HITACHI INDUSTRIAL EQUIPMENT SYSTEMS CO., LTD., Tokyo (JP)

( * ) Notice: Subject to any disclaimer, the term of this patent is extended or adjusted under 35 U.S.C. 154(b) by 276 days.

(21) Appl. No.: 18/026,362

(22) PCT Filed: Sep. 10, 2021

(86) PCT No.: PCT/JP2021/033266
§ 371 (c)(1),
(2) Date: Mar. 15, 2023

(87) PCT Pub. No.: WO2022/065072
PCT Pub. Date: Mar. 31, 2022

(65) Prior Publication Data

US 2023/0366391 A1 Nov. 16, 2023

(30) Foreign Application Priority Data

Sep. 25, 2020 (JP) ..... 2020-160658

(51) Int. Cl.
*F04C 28/08* (2006.01)
*F04B 49/03* (2006.01)
(Continued)

(52) U.S. Cl.
CPC ..... *F04C 28/08* (2013.01); *F04B 49/03* (2013.01); *F04B 49/20* (2013.01); *F04C 28/06* (2013.01);
(Continued)

(58) Field of Classification Search
CPC ..... F04C 28/08; F04C 28/24; F04C 28/06; F04C 2270/0525; F04C 2270/051;
(Continued)

(56) References Cited

U.S. PATENT DOCUMENTS 3,072,320 A * 1/1963 Cox ..... F04C 28/00 55/516
3,136,222 A * 6/1964 Hewitt ..... F02D 29/04 92/110
(Continued)

FOREIGN PATENT DOCUMENTS

JP 06-10876 A 1/1994
JP 2001-342982 A 12/2001
(Continued)

OTHER PUBLICATIONS

International Search Report of PCT/JP2021/033266 dated Oct. 21, 2021.
(Continued)

*Primary Examiner* — Christopher S Bobish
(74) *Attorney, Agent, or Firm* — MATTINGLY & MALUR, PC

(57) ABSTRACT

A gas compressor inhibits a supply delay of a compressed gas at a time of a return from no-load operation to load operation, and also reduces the consumed motive power. A controller switches between load operation and no-load operation by controlling a suction throttle valve according to a sensed delivery-side pressure, and also controls a rotation speed of an electric motor that drives the compressor. The controller is configured to compute a capacity C of an air supply system that supplies a compressed air generated by the air compressor to a use location of the compressed gas on a basis of load operation duration t1 and no-load operation duration t2, and set a target rotation speed of the electric
(Continued)

motor at a time of no-load operation on a basis of the capacity C of the air supply system.

7 Claims, 6 Drawing Sheets

(51) Int. Cl.
*F04B 49/20* (2006.01)
*F04C 28/06* (2006.01)
*F04C 28/24* (2006.01)

(52) U.S. Cl.
CPC ..... *F04C 28/24* (2013.01); *F04B 2205/05* (2013.01); *F04C 2270/051* (2013.01); *F04C 2270/0525* (2013.01); *F04C 2270/185* (2013.01)

(58) Field of Classification Search
CPC .... F04C 2270/185; F04B 49/08; F04B 49/20; F04B 2205/05; F04B 49/03; F04B 48/08; F04B 48/20
See application file for complete search history.

(56) References Cited

U.S. PATENT DOCUMENTS 6,461,112 B1 * 10/2002 Ohta ..... F04C 28/08 417/18
6,612,121 B2 * 9/2003 Moon ..... F24F 11/83 62/175
6,619,062 B1 * 9/2003 Shibamoto ..... F04C 29/126 62/228.3
RE40,554 E * 10/2008 Bass ..... A47F 3/04 417/220
9,746,228 B2 * 8/2017 Sibik ..... F04D 27/0246
2005/0086959 A1 * 4/2005 Wilson ..... B01D 53/265 62/228.3
2008/0314057 A1 * 12/2008 Lifson ..... B60H 1/3216 62/426
2011/0129361 A1 * 6/2011 Sato ..... F04C 28/28 417/213
2020/0011324 A1 * 1/2020 Oshiro ..... F04C 28/28
2020/0032801 A1 * 1/2020 Oguma ..... F04C 28/06

FOREIGN PATENT DOCUMENTS

JP 2019-138200 A 8/2019
JP 2020-16185 A 1/2020
WO 2018-179789 A1 10/2018

OTHER PUBLICATIONS

International Preliminary Report on Patentability received in corresponding International Application No. PCT/JP2021/033266 dated Apr. 6, 2023.

* cited by examiner

GAS COMPRESSOR

TECHNICAL FIELD

The present invention relates to a gas compressor that switches between load operation and no-load operation according to a delivery-side pressure of the compressor body.

BACKGROUND ART

Patent Document 1 discloses an air compressor which is one of gas compressors. The air compressor includes: an electric motor; a compressor body that is driven by the electric motor and compresses air; a pressure sensor arranged on a delivery side of the compressor body; an air release valve capable of releasing air from the delivery side of the compressor body; and a controller that switches between load operation and no-load operation by controlling the air release valve according to a delivery-side pressure sensed by the pressure sensor, and also controls the rotation speed of the electric motor. The compressed air generated by the air compressor is supplied to a use location of the compressed air via an air supply system.

The controller, when the delivery-side pressure sensed by the pressure sensor rises to a preset upper limit value, opens the air release valve having been closed to release air from the delivery side of the compressor body, and switches from load operation to no-load operation. Thereby, the consumed motive power is reduced. Thereafter, when the delivery-side pressure sensed by the pressure sensor drops to a preset lower limit value, the controller closes the air release valve having been opened, and returns from no-load operation to load operation.

The controller reduces the rotation speed of the electric motor at a time of no-load operation to be lower than the rotation speed of the electric motor at a time of load operation. Thereby, the consumed motive power is reduced further.

Prior Art Document

Patent Document

Patent Document 1: JP-2001-342982-A

SUMMARY OF THE INVENTION

Problem to be Solved by the Invention

In the conventional technology described above, a target rotation speed of the electric motor at a time of no-load operation is fixed independently of the capacity of the air supply system. Accordingly, for example, if a target rotation speed of the electric motor at a time of no-load operation is low despite a small capacity of the air supply system, a supply delay of the compressed air (compressed gas) occurs at a time of a return from no-load operation to load operation. Alternatively, for example, if a target rotation speed of the electric motor at a time of no-load operation is high despite a large capacity of the air supply system, there is room for a reduction of the target rotation speed of the electric motor at a time of no-load operation, that is, there is room for a reduction of the consumed motive power.

The present invention has been made in view of the matters described above, and one of objects of the present invention is to inhibit a supply delay of a compressed gas at a time of a return from no-load operation to load operation, and also to reduce the consumed motive power.

Means for Solving the Problem

In order to solve the problem described above, configuration described in claims is applied. The present invention includes a plurality of means for solving the problem described above, and an example thereof is a gas compressor including: an electric motor; a compressor body that is driven by the electric motor and compresses a gas; a pressure sensor arranged on a delivery side of the compressor body; at least one of a suction throttle valve capable of closing a suction side of the compressor body and an air release valve capable of releasing gas from the delivery side of the compressor body; and a controller that switches between load operation and no-load operation by controlling at least one of the suction throttle valve and the air release valve according to a delivery-side pressure sensed by the pressure sensor, and also controls a rotation speed of the electric motor, in which the controller is configured to compute a capacity of an air supply system that supplies a compressed gas generated by the gas compressor to a use location of the compressed gas, on a basis of load operation duration and no-load operation duration, and set a target rotation speed of the electric motor at a time of no-load operation on a basis of the capacity of the air supply system.

Advantages of the Invention

The present invention inhibits a supply delay of a compressed gas at a time of a return from no-load operation to load operation, and also can reduce the consumed motive power.

Note that problems, configuration, and advantages other than those described above are made clear by the following explanation.

MODES FOR CARRYING OUT THE INVENTION

A first embodiment of the present invention is explained with reference to figures.

Figure 1:
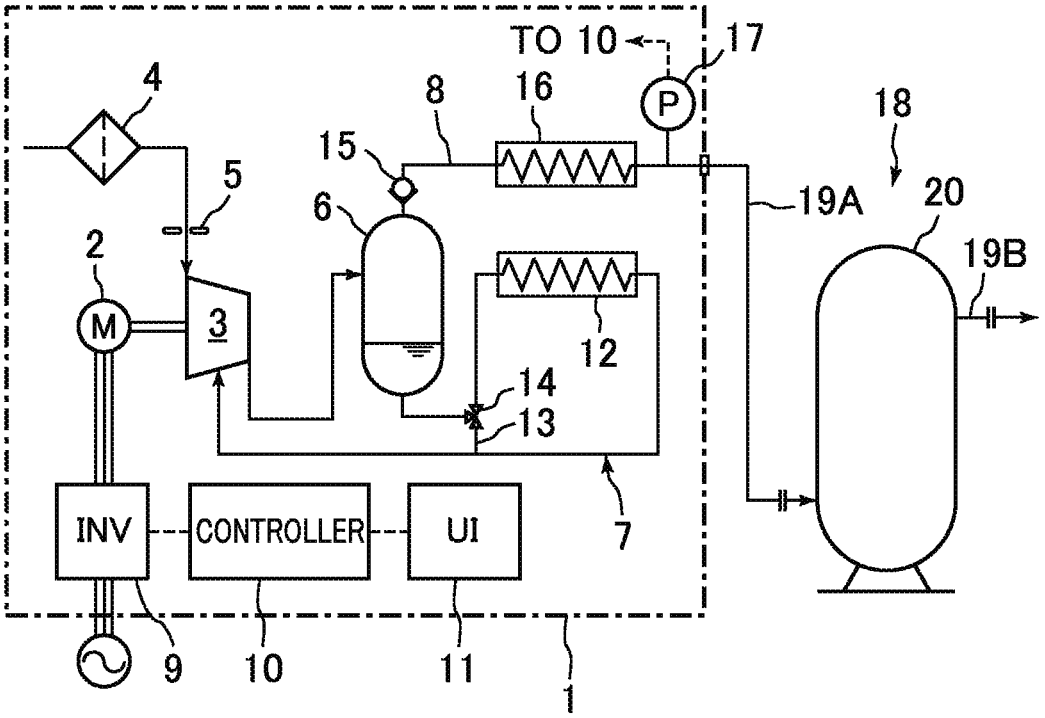
FIG. 1 is a schematic diagram representing configuration of an air compressor according to a first embodiment of the present invention.
Figure 2:
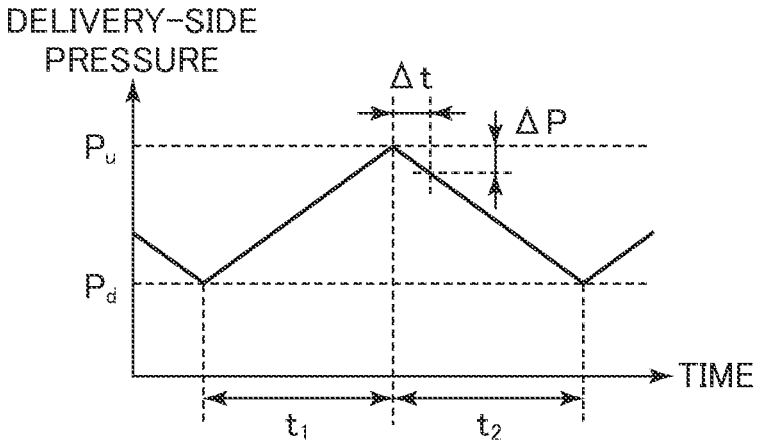
FIG. 2 is a figure depicting a specific example of temporal changes in the delivery-side pressure of a compressor body according to the first embodiment of the present invention.

FIG. 1 is a schematic diagram representing configuration of an air compressor according to the present embodiment. FIG. 2 is a figure depicting a specific example of temporal changes in the delivery-side pressure of a compressor body according to the present embodiment.

An air compressor 1 according to the present embodiment includes: an electric motor 2; a compressor body 3 that is driven by the electric motor 2 and compresses air (gas); a suction filter 4 provided on the suction side of the compressor body 3; a suction throttle valve 5 capable of closing the suction side of the compressor body 3; a separator 6 provided on the delivery side of the compressor body 3; an oil supply system 7 connected between a lower portion of the separator 6 and the compressor body 3; a compressed air pipe 8 connected to an upper portion of the separator 6; a controller 10 that controls the suction throttle valve 5, and also controls the rotation speed of the electric motor 2 via an inverter 9; and a user interface 11 connected to the controller 10. Note that the air compressor 1 is configured as a compressor unit that houses, in its housing, the equipment mentioned before.

The compressor body 3 has, although not depicted in figures, a pair of female and male screw rotors that mesh each other, and a casing that houses the screw rotors, and a plurality of compression chambers are formed between grooves of the screw rotors. Along with rotation of the rotors, each compression chamber moves in the axial direction of the rotors, and also sequentially performs a suction process of sucking in air, a compression process of compressing the air, and a delivery process of delivering the compressed air (compressed gas). The compressor body 3 is configured to inject an oil (liquid) to the compression chambers for the purpose of sealing the compression chambers, cooling compression heat, lubricating the rotors, and so on.

The separator 6 separates the oil from the compressed air delivered from the compressor body 3, and stores the separated oil. The oil supply system 7 supplies the oil stored in the separator 6 to the compression chambers and the like of the compressor body 3. The oil supply system 7 includes: an air-cooling-type or water-cooling-type oil cooler 12 that cools the oil; a bypass pipe 13 that bypasses the oil cooler 12; a temperature adjusting valve 14 that adjusts the flow division ratio for the oil cooler 12 and the flow division ratio for the bypass pipe 13, according to the temperature of the oil; and an oil filter (not depicted) arranged on the downstream side of a merging portion at which the oil from the oil cooler 12 and the oil from the bypass pipe 13 merge.

The compressed air pipe 8 includes: a pressure regulating check valve 15; an air-cooling-type or water-cooling-type aftercooler 16 that is arranged on the downstream side of the pressure regulating check valve 15, and cools the compressed air; a dryer (not depicted) that is arranged on the downstream side of the aftercooler 16, and dehumidifies the compressed air; and a pressure sensor 17 arranged on the downstream side of the dryer (i.e. near the outlet of the compressed air pipe 8). The pressure sensor 17 senses a delivery-side pressure, and outputs the delivery-side pressure to the controller 10.

The user interface 11 includes a plurality of operation switches and a monitor, for example, and has a functionality of selecting activation/deactivation of an energy saving mode. Although not depicted in figures, the controller 10 has: a computation control section (e.g. a CPU) that executes computation processes or control processes on the basis of programs; a storage section (e.g. a ROM, a RAM) that stores the programs and results of the computation processes; and the like. The controller 10 controls driving of the electric motor 2 according to operation on the user interface 11.

The controller 10 closes the suction throttle valve 5 having been opened to close the suction side of the compressor body 3, and switches from load operation to no-load operation, when the delivery-side pressure sensed by the pressure sensor 17 rises to a preset upper limit value Pu (see FIG. 2). Thereafter, when the delivery-side pressure sensed by the pressure sensor 17 drops to a preset lower limit value Pd (see FIG. 2), the controller 10 opens the suction throttle valve 5 having been closed, and switches from no-load operation to load operation.

The controller 10 controls the rotation speed of the electric motor 2 such that it becomes a preset target rotation speed at a time of load operation. In addition, the controller 10 controls the rotation speed of the electric motor 2 at a time of no-load operation such that it becomes a target rotation speed that is set as mentioned later.

The outlet side of the compressed air pipe 8 (i.e. the outer side of the air compressor 1) is connected with an air supply system 18. The air supply system 18 includes air supply pipes 19A and 19B and an air container 20, for example, and is configured to supply the compressed air generated by the air compressor 1 to a use location of the compressed air.

Here, the most significant feature of the present embodiment is that the controller 10 is configured to compute a capacity C of the air supply system 18 on the basis of load operation duration t1 (specifically, as depicted in FIG. 2, time during which the delivery-side pressure sensed by the pressure sensor 17 rises from the lower limit value Pd to the upper limit value Pu), and no-load operation duration t2 (specifically, time during which the delivery-side pressure sensed by the pressure sensor 17 drops from the upper limit value Pu to the lower limit value Pd), and set a target rotation speed of the electric motor 2 at a time of no-load operation on the basis of the capacity C of the air supply system 18. Details of this are explained by using FIG. 3.

Figure 3:
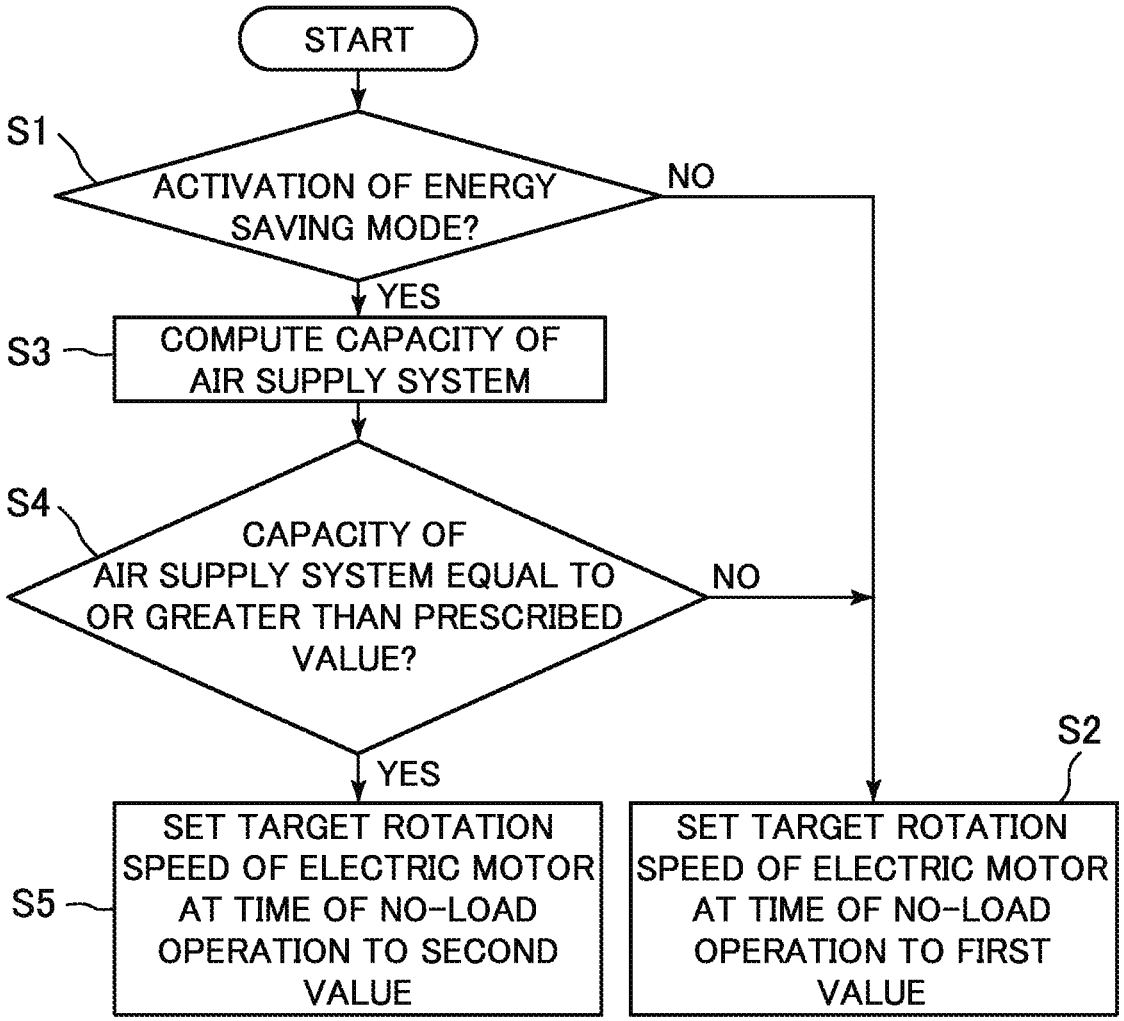
FIG. 3 is a flowchart representing the content of processing by a controller according to the first embodiment of the present invention.

FIG. 3 is a flowchart representing the content of processing by the controller according to the present embodiment.

At Step S1, the controller 10 determines whether or not activation of the energy saving mode is selected on the user interface 11. When deactivation of the energy saving mode is selected, the procedure proceeds to Step S2. At Step S2, the controller 10 sets the target rotation speed of the electric motor 2 at a time of no-load operation to a first value (Na). Thereafter, the controller 10 controls the rotation speed of the electric motor 2 at a time of no-load operation such that it becomes the target rotation speed Na. Note that the first value (Na) may be the same as or lower than a target rotation speed of the electric motor 2 at a time of load operation.

When activation of the energy saving mode is selected at Step S1, the procedure proceeds to Step S3. At Step S3, the controller 10 computes the capacity C of the air supply system 18 by using the following Formula (1), for example. Q in the formula is a rated air supply flow rate of the air compressor 1, A is a coefficient, and (t1/(t1+t2)) is equivalent to a load factor. Note that the load operation duration t1 or the no-load operation duration t2 may be a value measured by using a timer in one cycle, or may be the average computed from a plurality of values measured by using a timer in a plurality of cycles.

[Equation 1]

$$C = \frac{Q \times \left(\frac{t_1}{t_1 + t_2}\right) \times t_2 \times A}{P_u - P_d} \tag{1}$$

Thereafter, the procedure proceeds to Step S4, and the controller 10 determines whether or not the capacity C of the air supply system 18 computed at Step S3 is equal to or greater than a prescribed value. Where the capacity C of the air supply system 18 is smaller than the prescribed value, the procedure proceeds to Step S2. At Step S2, the controller 10 sets the target rotation speed of the electric motor 2 at a time of no-load operation to the first value (Na). Thereafter, the controller 10 controls the rotation speed of the electric motor 2 at a time of no-load operation such that it becomes the target rotation speed Na.

Where the capacity C of the air supply system 18 is equal to or greater than the prescribed value at Step S4, the procedure proceeds to Step S5. At Step S5, the controller 10 sets the target rotation speed of the electric motor 2 at a time of no-load operation to a second value (Nb) lower than the first value (Na). Thereafter, the controller 10 controls the rotation speed of the electric motor 2 at a time of no-load operation such that it becomes the target rotation speed Nb.

As mentioned above, in the present embodiment, where the capacity C of the air supply system 18 is smaller than the prescribed value, the target rotation speed of the electric motor 2 at a time of no-load operation is set to the first value (Na) greater than the second value (Nb). Thereby, it is possible to inhibit a supply delay of compressed air at a time of a return from no-load operation to load operation. On the other hand, where the capacity C of the air supply system 18 is equal to or greater than the prescribed value, the target rotation speed of the electric motor 2 at a time of no-load operation is set to the second value (Nb) lower than the first value (Na). Thereby, it is possible to reduce the consumed motive power while inhibiting a supply delay of compressed air at a time of a return from no-load operation to load operation.

Figure 4:
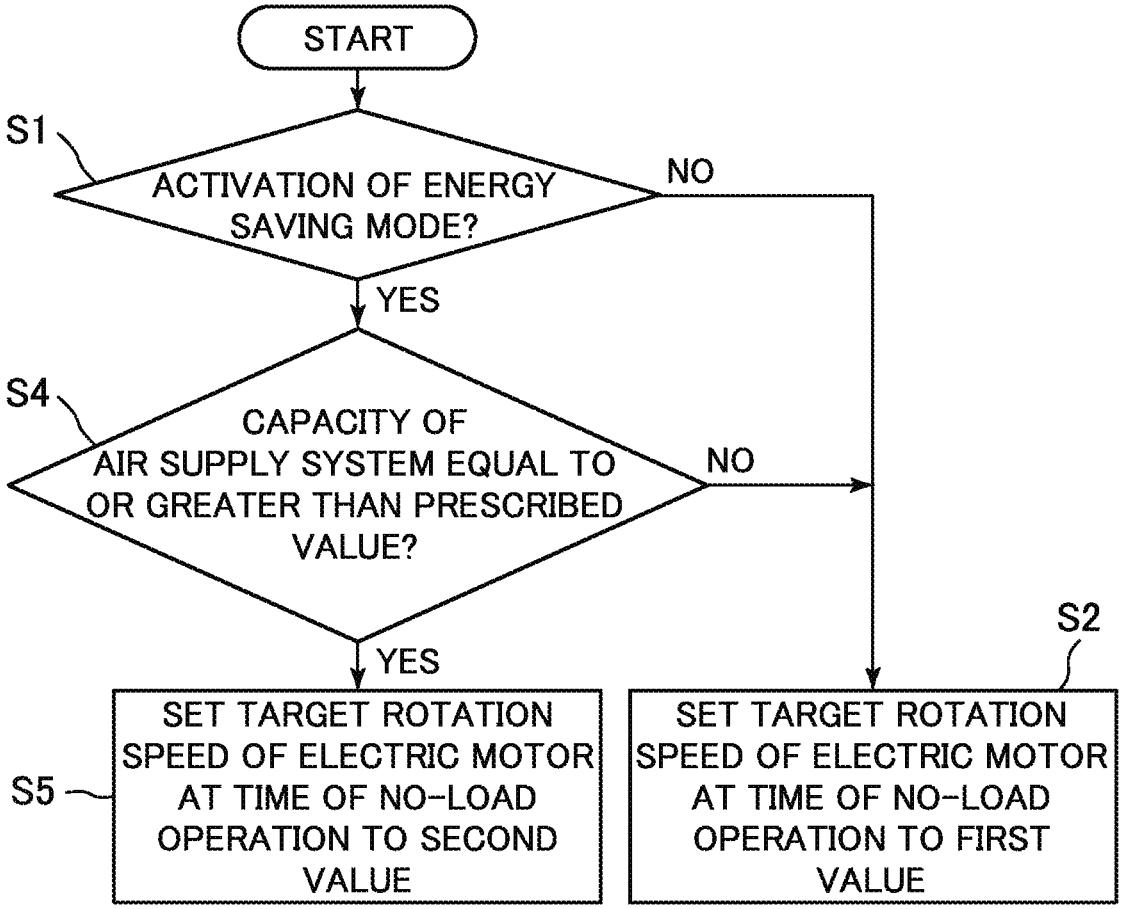
FIG. 4 is a flowchart representing the content of processing by the controller according to a first modification example of the present invention.

Note that whereas the controller 10 has a functionality of computing the capacity C of the air supply system 18 in the case explained as an example in the first embodiment, instead of this, the user interface 11 may have a functionality of accepting input of the capacity C of the air supply system 18. That is, the air compressor 1 may include an input apparatus that accepts input of the capacity C of the air supply system 18. Such a first modification example is explained by using FIG. 4. FIG. 4 is a flowchart representing the content of processing by the controller according to the present modification example.

At Step S1, the controller 10 determines whether or not activation of the energy saving mode is selected on the user interface 11. When deactivation of the energy saving mode is selected, the procedure proceeds to Step S2. At Step S2, the controller 10 sets the target rotation speed of the electric motor 2 at a time of no-load operation to the first value (Na). Thereafter, the controller 10 controls the rotation speed of the electric motor 2 at a time of no-load operation such that it becomes the target rotation speed Na.

When activation of the energy saving mode is selected at Step S1, the procedure proceeds to Step S4. At Step S4, the controller 10 determines whether or not the capacity C of the air supply system 18 input on the user interface 11 is equal to or greater than the prescribed value. Where the capacity C of the air supply system 18 is smaller than the prescribed value, the procedure proceeds to Step S2. At Step S2, the controller 10 sets the target rotation speed of the electric motor 2 at a time of no-load operation to the first value (Na). Thereafter, the controller 10 controls the rotation speed of the electric motor 2 at a time of no-load operation such that it becomes the target rotation speed Na.

Where the capacity C of the air supply system 18 is equal to or greater than the prescribed value at Step S4, the procedure proceeds to Step S5. At Step S5, the controller 10 sets the target rotation speed of the electric motor 2 at a time of no-load operation to the second value (Nb) lower than the first value (Na). Thereafter, the controller 10 controls the rotation speed of the electric motor 2 at a time of no-load operation such that it becomes the target rotation speed Nb.

The first modification example mentioned above also can attain advantages similar to those attained in the first embodiment.

Note that whereas the controller 10 makes a comparison with one prescribed value to thereby determine which one of two levels the capacity C of the air supply system 18 is, and, according to this, sets the target rotation speed of the electric motor 2 at a time of no-load operation to one of two levels in the cases explained as examples in the first embodiment and the like, these are not the sole examples. The controller 10 may make a comparison with two or more prescribed values to thereby determine which one of three or more levels the capacity C of the air supply system 18 is, and, according to this, set the target rotation speed of the electric motor 2 at a time of no-load operation to one of three or more levels.

A second embodiment of the present invention is explained. Note that portions in the present embodiment having their counterparts in the first embodiment are given identical reference characters, and explanations thereof are omitted as appropriate.

The controller 10 according to the present embodiment is configured to set the target rotation speed of the electric motor 2 at a time of no-load operation, according to not only the capacity C of the air supply system 18, but also a delivery-side pressure drop range ΔP (see FIG. 2 mentioned above) after each lapse of predetermined time Δt during no-load operation. Details of this are explained by using FIG. 5.

Figure 5:
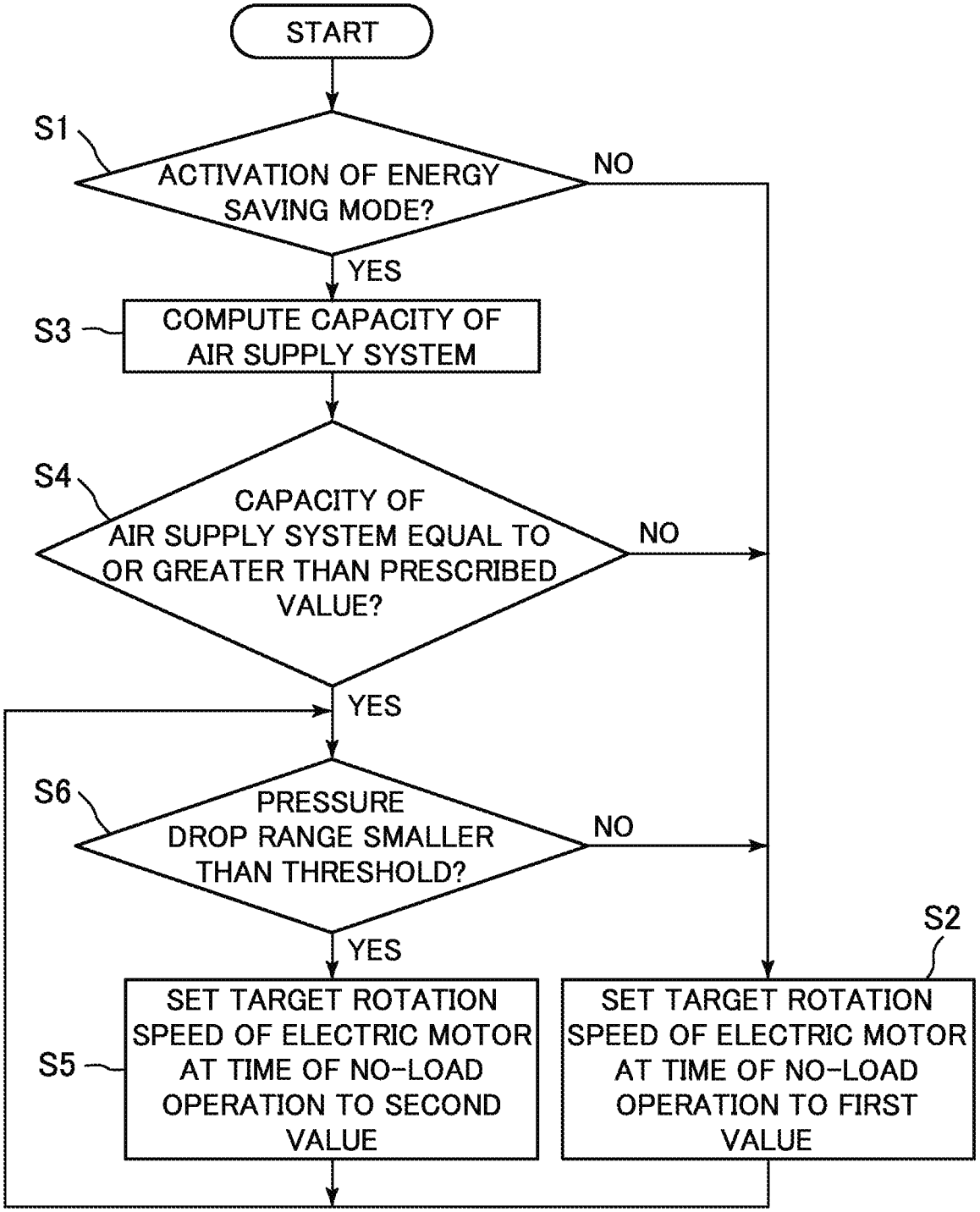
FIG. 5 is a flowchart representing the content of processing by the controller according to a second embodiment of the present invention.

FIG. 5 is a flowchart representing the content of processing by the controller according to the present embodiment.

At Step S1, the controller 10 determines whether or not activation of the energy saving mode is selected on the user interface 11. When deactivation of the energy saving mode is selected, the procedure proceeds to Step S2. At Step S2, the controller 10 sets the target rotation speed of the electric motor 2 at a time of no-load operation to the first value (Na). Thereafter, the controller 10 controls the rotation speed of the electric motor 2 at a time of no-load operation such that it becomes the target rotation speed Na.

When activation of the energy saving mode is selected at Step S1, the procedure proceeds to Step S3. At Step S3, the controller 10 computes the capacity C of the air supply system 18 by using Formula (1) described above.

Thereafter, the procedure proceeds to Step S4, and the controller 10 determines whether or not the capacity C of the air supply system 18 computed at Step S3 is equal to or greater than the prescribed value. Where the capacity C of the air supply system 18 is smaller than the prescribed value, the procedure proceeds to Step S2. At Step S2, the controller 10 sets the target rotation speed of the electric motor 2 at a time of no-load operation to the first value (Na). Thereafter, the controller 10 controls the rotation speed of the electric motor 2 at a time of no-load operation such that it becomes the target rotation speed Na.

Where the capacity C of the air supply system 18 is equal to or greater than the prescribed value at Step S4, the procedure proceeds to Step S6. At Step S6, the controller 10 determines whether or not the delivery-side pressure drop range ΔP is smaller than a threshold after each elapse of the predetermined time Δt during no-load operation. When the delivery-side pressure drop range ΔP is equal to or greater than the threshold, the procedure proceeds to Step S2. At Step S2, the controller 10 sets the target rotation speed of the electric motor 2 at a time of no-load operation to the first value (Na). Then, the controller 10 controls the rotation speed of the electric motor 2 such that it becomes the target rotation speed Na.

When the delivery-side pressure drop range ΔP is smaller than the threshold at Step S6, the procedure proceeds to Step S5. At Step S5, the controller 10 sets the target rotation speed of the electric motor 2 at a time of no-load operation to the second value (Nb) lower than the first value (Na). Then, the controller 10 controls the rotation speed of the electric motor 2 such that it becomes the target rotation speed Nb.

As mentioned above, in the present embodiment, where the capacity C of the air supply system 18 is smaller than the prescribed value, the target rotation speed of the electric motor 2 at a time of no-load operation is set to the first value (Na) greater than the second value (Nb). In addition, when the delivery-side pressure drop range ΔP after a lapse of the predetermined time Δt during no-load operation becomes equal to or greater than the threshold (i.e. when the use amount of compressed air is large) in a case where the capacity C of the air supply system 18 is equal to or greater than the prescribed value, the target rotation speed of the electric motor 2 at a time of no-load operation is set to the first value (Na) greater than the second value (Nb). Thereby, it is possible to inhibit a supply delay of compressed air at a time of a return from no-load operation to load operation. On the other hand, when the delivery-side pressure drop range ΔP after a lapse of the predetermined time Δt during no-load operation becomes smaller than the threshold (i.e. when the use amount of compressed air is small) in the case where the capacity C of the air supply system 18 is equal to or greater than the prescribed value, the target rotation speed of the electric motor 2 at a time of no-load operation is set to the second value (Nb) lower than the first value (Na). Thereby, it is possible to reduce the consumed motive power while inhibiting a supply delay of compressed air at a time of a return from no-load operation to load operation.

Figure 6:
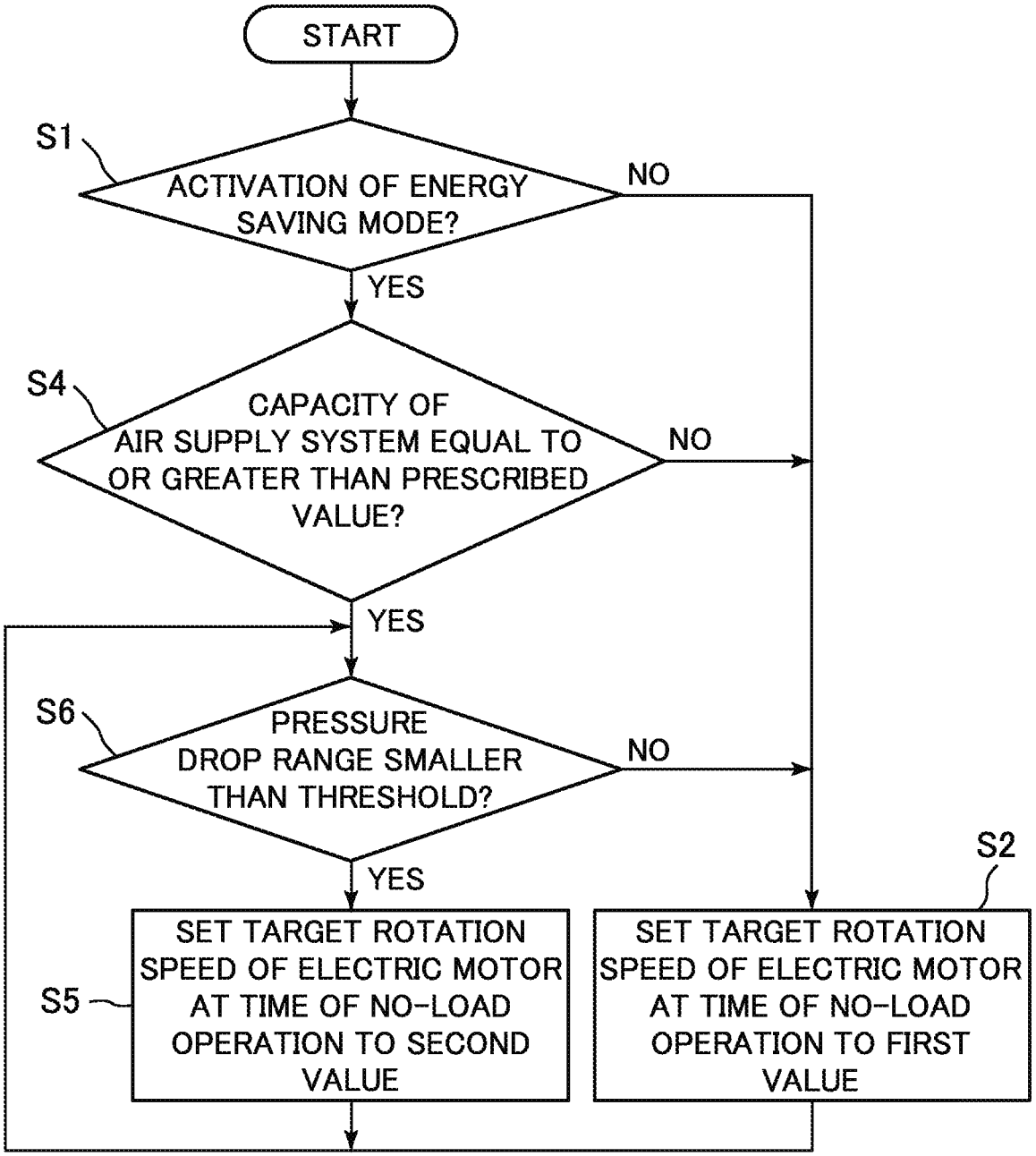
FIG. 6 is a flowchart representing the content of processing by the controller according to a second modification example of the present invention.

Note that whereas the controller 10 has a functionality of computing the capacity C of the air supply system 18 in the case explained as an example in the second embodiment, instead of this, the user interface 11 may have a functionality of accepting input of the capacity C of the air supply system 18. The air compressor 1 may include an input apparatus that accepts input of the capacity C of the air supply system 18. Such a second modification example is explained by using FIG. 6. FIG. 6 is a flowchart representing the content of processing by the controller according to the present modification example.

FIG. 6 is a flowchart representing the content of processing by the controller according to the present modification example.

At Step S1, the controller 10 determines whether or not activation of the energy saving mode is selected on the user interface 11. When deactivation of the energy saving mode is selected, the procedure proceeds to Step S2. At Step S2, the controller 10 sets the target rotation speed of the electric motor 2 at a time of no-load operation to the first value (Na). Thereafter, the controller 10 controls the rotation speed of the electric motor 2 at a time of no-load operation such that it becomes the target rotation speed Na.

When activation of the energy saving mode is selected at Step S1, the procedure proceeds to Step S4. At Step S4, the controller 10 determines whether or not the capacity C of the air supply system 18 input on the user interface 11 is equal to or greater than the prescribed value. Where the capacity C of the air supply system 18 is smaller than the prescribed value, the procedure proceeds to Step S2. At Step S2, the controller 10 sets the target rotation speed of the electric motor 2 at a time of no-load operation to the first value (Na). Thereafter, the controller 10 controls the rotation speed of the electric motor 2 at a time of no-load operation such that it becomes the target rotation speed Na.

Where the capacity C of the air supply system 18 is equal to or greater than the prescribed value at Step S4, the procedure proceeds to Step S6. At Step S6, the controller 10 determines whether or not the delivery-side pressure drop range ΔP is smaller than the threshold after each elapse of the predetermined time Δt during no-load operation. When the delivery-side pressure drop range ΔP is equal to or greater than the threshold, the procedure proceeds to Step S2. At Step S2, the controller 10 sets the target rotation speed of the electric motor 2 at a time of no-load operation to the first value (Na). Then, the controller 10 controls the rotation speed of the electric motor 2 such that it becomes the target rotation speed Na.

When the delivery-side pressure drop range ΔP is smaller than the threshold at Step S6, the procedure proceeds to Step S5. At Step S5, the controller 10 sets the target rotation speed of the electric motor 2 at a time of no-load operation to the second value (Nb) lower than the first value (Na). Then, the controller 10 controls the rotation speed of the electric motor 2 such that it becomes the target rotation speed Nb.

The second modification example mentioned above also can attain advantages similar to those attained in the second embodiment.

Note that whereas the user interface 11 has a functionality for selecting activation/deactivation of the energy saving mode, that is, the air compressor 1 has a selecting apparatus that accepts a selection of activation/deactivation of the energy saving mode in the cases explained as examples in the first and second embodiments and the like, these are not the sole examples. The user interface 11 may not have a functionality for selecting activation/deactivation of the energy saving mode, and the controller 10 may not perform Step S1 (specifically, a determination as to whether activation of the energy saving mode is selected).

In addition, whereas the air compressor 1 includes the suction throttle valve 5 capable of closing the suction side of the compressor body 3, and the controller 10 switches between load operation and no-load operation by controlling the suction throttle valve 5 according to the delivery-side pressure sensed by the pressure sensor 17 in the cases explained as examples in the first and second embodiments and the like, these are not the sole examples. The air compressor 1 may include, instead of the suction throttle valve 5, an air release valve (not depicted) capable of releasing gas from the delivery side of the compressor body 3, and the controller 10 may switch between load operation and no-load operation by controlling the air release valve according to the delivery-side pressure sensed by the pressure sensor 17. In addition, the air compressor 1 may include the suction throttle valve 5 and the air release valve, and the controller 10 may switch between load operation and no-load operation by controlling the suction throttle valve 5 and the air release valve according to the delivery-side pressure sensed by the pressure sensor 17.

In addition, whereas the air compressor 1 is an oil-supply-type air compressor (specifically, an air compressor that injects an oil to compression chambers of the compressor body 3), and includes the separator 6 that separates the oil from compressed air delivered from the compressor body 3, and the oil supply system 7 that supplies the oil separated by the separator 6 to the compression chambers and the like of the compressor body 3 in the cases explained as examples in the first and second embodiments and the like, these are not the sole examples. For example, the air compressor may be a water-supply-type air compressor (specifically, an air compressor that injects water to compression chambers of the compressor body), and may include a separator that separates the water from compressed air delivered from the compressor body, and a water supply system that supplies the water separated by the separator to the compression chambers and the like of the compressor body. In addition, for example, the air compressor may be a non-liquid-supply-type air compressor (specifically, an air compressor that does not inject a liquid such as water or an oil to compression chambers of the compressor body), and may not include a separator and a liquid supply system.

In addition, whereas the air compressor 1 includes a single stage of the compressor body 3 in the cases explained as examples in the first and second embodiments and the like, these are not the sole examples. The air compressor may include a plurality of stages of compressor bodies.

In addition, whereas the compressor body 3 is a screw-type air compressor, and includes a pair of female and male screw rotors in the cases explained as examples in the first and second embodiments, these are not the sole examples. For example, the compressor body may include one screw rotor and a plurality of gate rotors. In addition, the compressor body may be another type of compressor body other than a screw-type compressor body such as a displacement-type compressor body (specifically, a tooth-type or reciprocating-type compressor body, etc.), or may be a turbo-type compressor body.

Note that whereas the subject to which the present invention is applied is an air compressor which is one of gas compressors in examples explained above, these are not the sole examples, and the subject may be another gas compressor.

DESCRIPTION OF REFERENCE CHARACTERS

1: Air compressor
2: Electric motor
3: Compressor body
10: Controller
11: User interface
17: Pressure sensor
18: Air supply system

The invention claimed is:

1. A gas compressor comprising:
an electric motor;
a compressor body that is driven by the electric motor and compresses a gas;
a pressure sensor arranged on a delivery side of the compressor body;
at least one of a suction throttle valve capable of closing a suction side of the compressor body and an air release valve capable of releasing gas from the delivery side of the compressor body; and
a controller that switches between load operation and no-load operation by controlling at least one of the suction throttle valve and the air release valve according to a delivery-side pressure sensed by the pressure sensor, and also controls a rotation speed of the electric motor,
wherein the controller is configured to:
compute a capacity of an air supply system that supplies a compressed gas generated by the gas compressor to a use location of the compressed gas, on a basis of load operation duration and no-load operation duration, and
set a target rotation speed of the electric motor at a time of no-load operation on a basis of the capacity of the air supply system.

2. The gas compressor according to claim 1,
wherein the controller is configured to:
set the target rotation speed of the electric motor at a time of no-load operation to a first value in a case where the capacity of the air supply system is smaller than a prescribed value, and
set the target rotation speed of the electric motor at a time of no-load operation to a second value lower than the first value in a case where the capacity of the air supply system is equal to or greater than the prescribed value.

3. The gas compressor according to claim 1,
wherein the controller is configured to:
set the target rotation speed of the electric motor at a time of no-load operation to a first value in a case where the capacity of the air supply system is smaller than a prescribed value,
set the target rotation speed of the electric motor at a time of no-load operation to the first value when a delivery-side pressure drop range after a lapse of predetermined time during no-load operation becomes equal to or greater than a threshold in a case where the capacity of the air supply system is equal to or greater than the prescribed value, and
set the target rotation speed of the electric motor at a time of no-load operation to a second value lower than the first value when a delivery-side pressure drop range after a lapse of predetermined time during no-load operation becomes smaller than the threshold in the case where the capacity of the air supply system is equal to or greater than the prescribed value.

4. The gas compressor according to claim 1, further comprising:
a selecting apparatus that accepts a selection of activation/deactivation of an energy saving mode,
wherein the controller is configured to:
fix the target rotation speed of the electric motor at a time of no-load operation independently of the capacity of the air supply system when deactivation of the energy saving mode is selected on the selecting apparatus, and
change the target rotation speed of the electric motor at a time of no-load operation on a basis of the capacity of the air supply system when activation of the energy saving mode is selected on the selecting apparatus.

5. A gas compressor comprising:
an electric motor;
a compressor body that is driven by the electric motor and compresses a gas;
a pressure sensor arranged on a delivery side of the compressor body;
at least one of a suction throttle valve capable of closing a suction side of the compressor body and an air release valve capable of releasing gas from the delivery side of the compressor body; and
a controller configured to switch between a load operation and a no-load operation by controlling at least one of the suction throttle valve and the air release valve according to a delivery-side pressure sensed by the pressure sensor, and also controls a rotation speed of the electric motor, wherein the gas compressor includes an input apparatus that accepts input of a capacity of an air supply system that supplies a compressed gas generated by the gas compressor to a use location of the compressed gas, and wherein the controller is configured to:

set the target rotation speed of the electric motor at a time of no-load operation to a first value in a case where the capacity of the air supply system is smaller than a prescribed value, and set the target rotation speed of the electric motor at a time of no-load operation to a second value lower than the first value in a case where the capacity of the air supply system is equal to or greater than the prescribed value.

6. The gas compressor according to claim 5, further comprising:

a selecting apparatus that accepts a selection of activation/deactivation of an energy saving mode, wherein the controller is configured to:

fix the target rotation speed of the electric motor at a time of no-load operation independently of the capacity of the air supply system when deactivation of the energy saving mode is selected on the selecting apparatus, and change the target rotation speed of the electric motor at a time of no-load operation on a basis of the capacity of the air supply system when activation of the energy saving mode is selected on the selecting apparatus.

7. The gas compressor according to claim 5, wherein the controller is configured to:

set the target rotation speed of the electric motor at a time of no-load operation to the first value when a delivery-side pressure drop range after a lapse of predetermined time during no-load operation becomes equal to or greater than a threshold in a case where the capacity of the air supply system is equal to or greater than the prescribed value, and set the target rotation speed of the electric motor at a time of no-load operation to the second value lower than the first value when a delivery-side pressure drop range after a lapse of predetermined time during no-load operation becomes smaller than the threshold in the case where the capacity of the air supply system is equal to or greater than the prescribed value.

* * * * *